US006034050A

United States Patent [19]

Artiga Gonzalez et al.

[11] Patent Number: 6,034,050

[45] **Date of Patent: *Mar. 7, 2000**

[54] AMORPHOUS ALKALI METAL SILICATE COMPOUND

[75] Inventors: Rene-Andrés Artiga Gonzalez; Volker Bauer, both of Duesseldorf; Katrin Burmeister, Poing; Stefan Hammelstein, Duesseldorf, all of Germany

[73] Assignee: Henkel Kommanditgesellschaft auf Aktien, Duesseldorf, Germany

[ * ] Notice: This patent is subject to a terminal disclaimer.

[21] Appl. No.: 08/981,923

[22] PCT Filed: Jul. 3, 1996

[86] PCT No.: PCT/EP96/02902

§ 371 Date: Jan. 12, 1998

§ 102(e) Date: Jan. 12, 1998

[87] PCT Pub. No.: WO97/03168

PCT Pub. Date: Jan. 30, 1997

[30] Foreign Application Priority Data

Jul. 12, 1995 [DE] Germany ..... 195 25 378

[51] Int. Cl.[7] ..... C11D 3/08; C11D 3/10; C11D 11/00

[52] U.S. Cl. ..... 510/451; 510/509; 510/511; 510/443; 510/444; 510/452

[58] Field of Search ..... 510/509, 511, 510/443, 444, 452, 451

[56] References Cited

U.S. PATENT DOCUMENTS

| | | | |
|---|---|---|---|
| 3,838,193 | 9/1974 | Kajitani et al. | 423/351 |
| 3,879,527 | 4/1975 | Bertorelli et al. | 423/332 |
| 3,912,649 | 10/1975 | Bertorelli et al. | 252/135 |
| 3,956,467 | 5/1976 | Bertorelli | 423/332 |
| 4,265,790 | 5/1981 | Winston et al. | 252/532 |
| 4,664,839 | 5/1987 | Rieck | 252/175 |
| 4,816,553 | 3/1989 | Baur et al. | 528/245 |
| 4,820,439 | 4/1989 | Rieck | 252/135 |
| 5,318,733 | 6/1994 | Carduck et al. | 264/15 |
| 5,501,814 | 3/1996 | Engelskirchen et al. | 252/174.17 |
| 5,541,316 | 7/1996 | Engelskirchen et al. | 510/471 |
| 5,580,941 | 12/1996 | Krause et al. | 527/300 |

FOREIGN PATENT DOCUMENTS

| | | |
|---|---|---|
| 0 164 514 | 12/1985 | European Pat. Off. . |
| 0 280 223 | 8/1988 | European Pat. Off. . |
| 0 353 562 | 2/1990 | European Pat. Off. . |
| 0 488 868 | 6/1992 | European Pat. Off. . |
| 0 525 239 | 2/1993 | European Pat. Off. . |
| 0 526 978 | 2/1993 | European Pat. Off. . |
| 0 542 131 | 5/1993 | European Pat. Off. . |
| 0 561 656 | 9/1993 | European Pat. Off. . |
| 0 651 050 | 5/1995 | European Pat. Off. . |
| 42 03 031 | 8/1993 | Germany . |
| 42 21 381 | 2/1994 | Germany . |
| 43 00 772 | 7/1994 | Germany . |
| 44 35 743 | 8/1995 | Germany . |
| 44 19 745 | 12/1995 | Germany . |
| 44 42 977 | 6/1996 | Germany . |
| 195 01 269 | 7/1996 | Germany . |
| WO91/02047 | 2/1991 | WIPO . |
| WO93/02176 | 2/1993 | WIPO . |
| WO93/08251 | 4/1993 | WIPO . |
| WO93/16110 | 8/1993 | WIPO . |
| WO94/09111 | 4/1994 | WIPO . |

OTHER PUBLICATIONS

Ullmans Encyklopaedie die der technischen Chemie, 4ed., vol. 21, p. 412–13 (1982).
DIN ISO 787 (Feb. 1983).

*Primary Examiner*—Yogendra Gupta
*Assistant Examiner*—Dawn L. Garrett
*Attorney, Agent, or Firm*—Ernest G. Szoke; Wayne C. Jaeschke; Glenn E. J. Murphy

[57] ABSTRACT

A process for producing an anionic surfactant-containing alkali metal silicate-alkali metal carbonate compound providing multiple wash cycle performance, wherein the compound contains 15% to 50% by weight of alkali metal silicate which is x-ray amorphous and has a molar $M_2O$ to $SiO_2$ ratio of 1:1.5 to 1:3.3 and M represents an alkali metal, 30% to 70% by weight of alkali metal carbonate, 1.5% to 15% by weight of anionic surfactant and 12% to 19% by weight of water, by providing a powder component selected from alkali metal carbonate, alkali metal silicate, or a mixture of alkali metal carbonate and alkali metal silicate, and agglomerating the powder component with an aqueous composition containing one or more anionic surfactants.

2 Claims, No Drawings

AMORPHOUS ALKALI METAL SILICATE COMPOUND

BACKGROUND OF THE INVENTION

1. Field of the Invention

This invention relates to a process for the production of a surfactant-containing amorphous alkali metal silicate/alkali metal carbonate compound with multiple wash cycle performance which may be used as a water-soluble builder in detergents or cleaners, to the use of such alkali metal silicate compounds in detergents or cleaners, to extruded detergents or cleaners and to a process for their production.

Modern compacted detergents or cleaners generally have the disadvantage that, on account of their compact structure, they exhibit poorer dissolving behavior in aqueous liquors than, for example, lighter spray-dried detergents or cleaners of the prior art. Detergents or cleaners generally tend to dissolve more slowly in water, the higher their degree of compaction. Because they are insoluble in water, the zeolites normally present as builders in detergents or cleaners can additionally contribute towards the impaired dissolving behavior.

A water-soluble alternative to zeolites are amorphous alkali metal silicates with multiple wash cycle performance.

2. Discussion of Related Art

It is known that powder-form hydrated water-soluble silicates still containing about 20% by weight of water can be obtained by the spray drying or roll drying of waterglass solutions (cf. Ullmanns Enzyclopädie der technischen Chemie, 4th Edition 1982, Vol. 21, page 412). Products of this type are commercially available for various purposes. Corresponding powders have a very loose structure as a result of spray drying. Their bulk densities are generally well below 700 g/l.

Granular alkali metal silicates with relatively high bulk densities can be obtained in accordance with the teaching of European patent application EP-A-0 526 978. In this process, an alkali metal silicate solution with a solids content of 30 to 53% by weight is introduced into a heated drum in the longitudinal axis of which rotates a shaft with a plurality of arms reaching almost to the inner surface of the drum, the drum wall having a temperature of 150 to 200° C. The drying process is supported by a gas introduced into the drum at a temperature of 175 to about 250° C. This process gives a product with an average particle size of 0.2 to 2 mm. A preferred drying gas is heated air.

European patent application EP-A-0 542 131 describes a process in which a product completely soluble in water at room temperature with a bulk density of 500 to 1200 g/l is obtained. Heated air is preferably used as the drying gas. This process also uses a cylindrical dryer with a heated wall (160 to 200° C.) in the longitudinal axis of which a rotor with blade-like vanes rotates at such a speed that a pseudoplastic paste with a free water content of 5 to 12% by weight is formed from the silicate solution with its solids content of 40 to 60% by weight. Drying is supported by a hot air stream (220 to 260° C.).

Earlier hitherto unpublished patent application P 44 19 745.4 also describes a water-soluble, amorphous and granular alkali metal silicate which is produced by a process similar to that described in EP-A-0 526 978, but contains silica. The term "amorphous" in this context means "X-ray amorphous". This means that the alkali metal silicates do not produce any sharp reflexes in X-ray diffraction patterns, but at best one or more broad maxima of which the width amounts to several degrees of the diffraction angle. However, this does not mean that regions producing sharp electron diffraction reflexes cannot be found in electron diffraction experiments. This may be interpreted to mean that the substance contains microcrystalline regions up to about 20 nm (max. 50 nm) in size.

Granular amorphous sodium silicates obtained by spray drying of aqueous waterglass solutions and subsequent grinding, compaction and spheronizing with additional drying of the ground material are the subject of U.S. Pat. Nos. 3,912,649, 3,956,467, 3,838,193 and 3,879,527. The products obtained have water contents of about 18 to 20% by weight for bulk densities well above 500 g/l.

Other granular alkali metal silicates with multiple wash cycle performance are known from European patent applications EP-A-0 561 656 and EP-A-0 488 868. These documents relate to compounds of alkali metal silicates with certain Q distributions and alkali metal carbonates. The products are obtained by granulating powder-form water-free sodium carbonate in the presence of a sodium silicate solution (waterglass solution) and drying the products so that they have a certain residual water content bound to the silicate. According to tests conducted by applicants, products such as these have a relatively low absorption capacity for nonionic surfactants of <30 g nonionic surfactants per 100 g of compound. It is not known from the prior art that compounds such as these can be produced using aqueous formulations of anionic surfactants.

Intentional patent application WO-A-91/02047 describes a process for the production of high-density extrudates in which a solid free-flowing compound is extruded under pressure in strand form. The solid free-flowing compound contains a plasticizer and/or lubricant which ensures that the compound softens and hence becomes extrudable under the pressure applied or under the effect of specific energy. After leaving the multiple-bore extrusion die, the system is not exposed to any further shearing so that its viscosity increases to such an extent that the extruded strand can be cut to predetermined extrudate dimensions. Now, it is known from International patent application WO-A-94/09111 that the compound to be extruded must contain both components which show pseudoplastic behavior and components which have dilatant properties. If the compound were only to contain components with pseudoplastic behavior, it would soften or even become almost liquid under the effect of the pronounced shear gradient to such an extent that, after leaving the multiple-bore die, the strand would no longer be cuttable. For this reason, dilatant components are also used, i.e. components which show increasing plasticity with increasing shear gradient and which thus guarantee the cuttability of the extruded strand. Most ingredients of detergents or cleaners show pseudoplastic behavior. Dilatant behavior is more the exception. However, there is one ingredient of conventional detergents or cleaners which does possess dilatant properties, namely the water-insoluble alumosilicates, such as zeolites, used as builders and phosphate substitutes. Although extruded detergents or cleaners containing 19% by weight of zeolite (based on water-free active substance), 12.5% by weight of sodium carbonate and 2.2% by weight of amorphous sodium silicate are known from International patent application WO-A-94/09111, it was not known that, in terms of process technology, zeolite could be partly or even completely replaced by water-soluble inorganic builders, such as amorphous alkali metal silicates, providing they are used in a certain form.

German patent application 195 01 269.0 describes amorphous alkali metal silicate compounds with multiple wash cycle performance and a molar ratio of $M_2O$ to $SiO_2$ (M=alkali metal) of 1:1.5 to 1:3.3 which contain anionic surfactants, preferably alkyl benzenesulfonates and/or alk(en)yl sulfates. In one preferred embodiment, these compounds additionally contain 30 to 70% by weight of alkali metal carbonate. They are produced by spray drying of an aqueous slurry containing all the ingredients of the alkali metal silicate compound.

EP-A-651 050 describes a process for the production of granules which contain as essential components an amorphous silicate, an anionic surfactant and another solid salt, for example sodium carbonate. This additional salt is initially introduced and is agglomerated with an aqueous "binder" of alkali metal silicate solution and anionic surfactant. Sodium carbonate is one of many suitable salt components. Whereas the binder contains the alkali metal silicate and the anionic surfactant in ratios by weight of 1:3 to 3:1, there is no mention whatever of the ratio by weight between "binder" and salt component. The agglomerates produced in accordance with the Examples have sodium carbonate contents below 10% by weight. The preferred salt present in quantities of 35.5% by weight in the Examples is sodium sulfate.

One of the problems addressed by the present invention was to provide further water-soluble builders for the partial or complete replacement of zeolite in detergents or cleaners so that the dissolving behavior of heavy detergents or cleaners in particular would be improved. In addition, these water-soluble builders would also have an absorption capacity for ingredients of detergents or cleaners which are liquid to wax-like at the processing temperature. Another problem addressed by the present invention was to provide extruded detergents or cleaners which would contain the water-soluble builders in such quantities that zeolite could be completely or partly replaced not only in performance terms, but also in terms of process technology, and a process for their production.

DESCRIPTION OF THE INVENTION

Accordingly, the present invention relates to a process for the production of an anionic-surfactant-containing alkali metal silicate/alkali metal carbonate compound with multiple wash cycle performance, the alkali metal silicate being X-ray amorphous and having a molar $M_2O$ to $SiO_2$ ratio (M=alkali metal) of 1:1.5 to 1:3.3 and the compound containing 15 to 50% by weight of alkali metal silicate, 30 to 70% by weight of alkali metal carbonate, 1.5 to 15% by weight of anionic surfactants and 12 to 19% by weight of water, characterized in that a powder-form component selected from alkali metal carbonate, alkali metal silicate or a mixture thereof is agglomerated using an aqueous preparation containing one or more anionic surfactants and, if necessary, that component of the compound to be produced which is not initially introduced in powder form. The expression "alkali metal carbonate" in the context of the invention is intended to encompass salts of carbonic acidin which one to two hydrogen ions is/are replaced by alkali metal ions. Examples are actual carbonates $M_2CO_3$ (M=alkali metal), hydrogen carbonates $MHCO_3$ and mixed carbonates such as, for example, Trona, $Na_3H(CO_3)_2.2H_2O$.

Both here and in the following, the expression "powder form" means that the substances are present in solid free-flowing form and at least 90% by weight of the particles have a particle diameter of 1 mm or less.

Preferred amorphous alkali metal silicates have a molar $M_2O$ to $SiO_2$ ratio (M=alkali metal) of 1:1.9 to 1:3 and, more particularly, 1:2.5. Sodium and/or potassium silicate are particularly suitable, sodium silicates being preferred on economic grounds. However, if for performance-related reasons emphasis is placed on a particularly high dissolving rate in water, it is advisable to replace sodium at least partly by potassium. For example, the composition of the alkali metal silicate may be selected so that the silicate has a potassium content, expressed as $K_2O$, of up to 5% by weight. Preferred alkali metal silicates are present in the form of a compound with alkali metal carbonate, preferably sodium and/or potassium carbonate. The water content of these preferred amorphous alkali metal silicate compounds is advantageously between 10 and 22% by weight and, more particularly, between 12 and 20% by weight. Water contents of 14 to 19% by weight are particularly preferred.

It is specifically pointed out that all known X-ray amorphous alkali metal silicates, mixtures of alkali metal silicates and alkali metal carbonates and alkali metal silicate compounds may be used for the production of the compounds according to the invention. These silicates may be produced by spray drying, granulation and/or compacting, for example by roll compacting. Carbonate- and silicate-compounds may also be produced by spray drying, granulation and/or compacting, for example by roll compacting. Some of these silicates and carbonate- and silicate-containing compounds are commercially available. This is the case, for example, with the products Britesil® (Akzo & Nobel), Nabion 15® (Rhône-Poulenc), Gransil® (Colin Stewart) and Dizzil® G (Akzo & Nobel). Preferred carbonate/alkali metal silicate compounds are those which have a ratio by weight of carbonate to silicate of 3:1 to 1:9 and, more particularly, 2.5:1 to 1:5. These commercially available alkali metal silicates or compounds may be granulated, for example, with aqueous solutions of anionic surfactants or even with anionic surfactant acids.

Even the amorphous silicates obtainable in accordance with the above-cited U.S. patents by spray drying or in granulators of the turbo dryer type manufactured, for example, by Vomm, Italy, are suitable and preferred starting materials with advantageous properties. Where turbo granulation is applied, the compounds may be directly produced by the process according to the invention. The process according to the invention for the production of alkali metal silicate/alkali metal carbonate compounds containing anionic surfactants may generally be carried out by introducing at least one of the components alkali metal silicate or alkali metal carbonate in powder form into a suitable mixer or into a fluidized bed and spraying on an aqueous solution of an anionic surfactant which, if necessary, additionally contains another component of the compound to be produced in dissolved and/or dispersed form. The anionic surfactant may be used in the form of an alkali metal salt, for example a sodium salt, in the form of a surfactant acid or in partly neutralized form. For example, powder-form alkali metal carbonate may be initially introduced and agglomerated using an aqueous alkali metal silicate solution containing anionic surfactant and optionally undissolved alkali metal silicate. Alternatively, powder-form alkali metal silicate may be initially introduced and agglomerated using an alkali metal carbonate solution containing anionic surfactant. In another embodiment, a powder-form mixture of alkali metal silicate and alkali metal carbonate may be initially introduced and agglomerated using an aqueous anionic surfactant formulation. This aqueous formulation may be a true solution, an emulsion or even a water-containing surfactant paste. Finally, the process according to the invention may also be carried out by agglomerating a preformed compound of alkali metal silicate and alkali metal carbonate with such an aqueous anionic surfactant formulation. The preformed compound of alkali metal silicate and alkali metal carbonate may be obtained, for example, by spray drying an aqueous solution or suspension containing both components. However, a compound obtainable by agglomerating one component in powder form with an aqueous solution of the second component may also be used for this purpose.

Sodium and/or potassium carbonate is preferably used as the alkali metal carbonate, sodium carbonate being preferred on economic grounds.

The mixing and agglomerating units known from the prior art may be used for the production of the compounds. Examples of such units include the turbo dryer described in more detail in the foregoing or even more slowly rotating drums equipped with mixing internals, granulating pans rotating about an axis preferably inclined to the vertical and a fluidized bed fluidized by a gas stream.

Anionic surfactants suitable for use in the alkali metal silicate compounds are, above all, surfactants of the sulfonate and/or sulfate type. Preferred surfactants of the sulfonate type are $C_{9-13}$ alkyl benzenesulfonates, olefin sulfonates, i.e. mixtures of alkene and hydroxyalkane sulfonates, and the disulfonates obtained, for example, from $C_{12-18}$ monoolefins with an internal or terminal double bond by sulfonation with gaseous sulfur trioxide and subsequent alkaline or acidic hydrolysis of the sulfonation products. Other suitable surfactants of the sulfonate type are alkane sulfonates obtained from $C_{12-18}$ alkanes, for example by sulfochlorination or sulfoxidation and subsequent hydrolysis or neutralization. Suitable surfactants of the sulfate type are the sulfuric acid monoesters of primary alcohols of natural and synthetic origin. Preferred alk(en)yl sulfates are the alkali metal salts and, more particularly, the sodium salts of sulfuric acid semiesters of $C_{12-18}$ fatty alcohols, for example cocofatty alcohol, tallow fatty alcohol, lauryl, myristyl, cetyl or stearyl alcohol or the $C_{10-20}$ oxoalcohols, and the semiesters of secondary alcohols with the same chain length. Other preferred surfactants of the sulfate type are alk(en)yl sulfates with the chain length mentioned which contain a synthetic linear alkyl chain based on petrochemicals and which are similar in their degradation behavior to the corresponding compounds based on oleochemical raw materials. $C_{16-18}$ alk(en)yl sulfates are particularly preferred from the washing point of view. It can also be of particular advantage, especially for machine detergents, to use $C_{16-18}$ alk(en)yl sulfates in combination with relatively low-melting anionic surfactants and, in particular, with anionic surfactants which have a relatively low Krafft point and a negligible tendency to crystallise at relatively low washing temperatures, for example in the range from room temperature to 40° C. In one preferred embodiment of the invention, therefore, the compounds contain mixtures of short-chain and long-chain fatty alkyl sulfates, preferably mixtures of $C_{12-14}$ fatty alkyl sulfates or $C_{12-18}$ fatty alkyl sulfates with $C_{12-18}$ fatty alkyl sulfates and, more particularly, $C_{12-16}$ fatty alkyl sulfates with $C_{16-18}$ fatty alkyl sulfates. However, another preferred embodiment of the invention is characterized by the use not only of saturated alkyl sulfates, but also of unsaturated alkenyl sulfates with an alkenyl chain length of preferably $C_{16}$ to $C_{22}$. Mixtures of saturated sulfonated fatty alcohols predominantly consisting of $C_{16}$ and unsaturated sulfonated fatty alcohols predominantly consisting of $C_{18}$, for example those derived from solid or liquid fatty alcohol mixtures of the HD-Ocenol® type (a commercial product of Henkel KGaA), are particularly preferred. Ratios by weight of alkyl sulfates to alkenyl sulfates of 10:1 to 1:2 are preferred, ratios by weight of about 5:1 to 1:1 being particularly preferred.

The sulfuric acid monoesters of linear or branched $C_{7-21}$ alcohols ethoxylated with 1 to 6 moles of ethylene oxide, such as 2-methyl-branched $C_{9-11}$ alcohols containing on average 3.5 moles of ethylene oxide (EO) or $C_{12-18}$ fatty alcohols containing 1 to 4 EO, are also suitable. Because of their tendency to foam vigorously, they are used in only relatively small quantities in detergents, for example in quantities of 1 to 5% by weight.

In one preferred embodiment of the invention, the compounds contain 15 to 80% by weight of alkali metal silicates, 1 to 20% by weight of anionic surfactants and 10 to 22% by weight, preferably 12 to 19% by weight and more preferably 14 to 19% by weight of water.

In another preferred embodiment of the invention, the compounds according to the invention contain 15 to 50% by weight and preferably 20 to 40% by weight of alkali metal silicates, 30 to 70% by weight and preferably 40 to 65% by weight of alkali metal carbonates, 1.5 to 15% by weight and more particularly 2 to 12% by weight of anionic surfactants, advantageously alkyl benzenesulfonates and/or alk(en)yl sulfates, and 12 to 19% by weight of water.

The alkali metal silicate compounds may additionally contain other ingredients of detergents or cleaners, preferably in quantities of up to 10% by weight and more preferably in quantities of not more than 5% by weight. Examples of these other ingredients are neutral salts, such as sodium or potassium sulfates, redeposition inhibitors and nonionic surfactants, such as alkyl polyglycosides.

The alkali metal silicate compounds according to the invention have a significant absorption capacity for ingredients of detergents or cleaners which are liquid to wax-like at the usual processing temperatures. Although alkali metal compounds with no anionic surfactants added are also capable of absorbing certain quantities of liquid components, it has been found that the addition of anionic surfactants increases the absorption capacity of the alkali metal silicate compounds and improves their flow behavior. In one preferred embodiment of the invention, the alkali metal silicate compounds containing anionic surfactants according to the invention have an absorption capacity for liquid components which is at least 20% higher than that of the same quantity of alkali metal silicate compounds with no added anionic surfactants. Particularly preferred compounds are those of which the absorption capacity for liquid components is increased by at least 30% and, advantageously, even by at least 50%, based on the absorption capacity of the same quantity of corresponding alkali metal silicate compounds with no added anionic surfactants.

In another embodiment, therefore, the invention relates to alkali metal silicate compounds produced in accordance with the invention which have been aftertreated with liquid components including ingredients of detergents or cleaners which are liquid to wax-like at the processing temperature. Suitable liquid components capable of being absorbed by the alkali metal silicate compounds according to the invention are, for example, nonionic surfactants, cationic surfactants and/or foam inhibitors, such as silicone oils and paraffin oils. However, nonionic surfactants, for example alkoxylated, preferably ethoxylated and/or ethoxylated and propoxylated, aliphatic $C_{8-22}$ alcohols are particularly preferred. Alcohols such as these include in particular primary alcohols preferably containing 8 to 18 carbon atoms and, on average, 1 to 12 moles of ethylene oxide (EO) per mole of alcohol in which the alcohol radical may be linear or, preferably, methyl-branched in the 2-position or may contain linear and methyl-branched radicals in the form of the mixtures normally present in oxoalcohol radicals. However, alcohol ethoxylates with linear radicals of alcohols of native origin containing 12 to 18 carbon atoms, for example of coconut oil fatty alcohol, palm oil fatty alcohol, tallow fatty alcohol or oleyl alcohol, and on average 2 to 8 EO per mole of alcohol are also preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned are statistical mean values which, for a given product, maybe a whole number of a broken number. Preferred alcohol ethoxylates have a narrow homolog distribution (narrow range ethoxylates, NRE). In addition to these nonionic surfactants, fatty alcohols containing more than 12 EO may also be used. Examples of such fatty alcohols are tallow fatty alcohol containing 14 EO, 25 EO, 30 EO or 40 EO.

The alkali metal silicate compounds produced in accordance with the invention may be subsequently treated with ingredients of detergents or cleaners. This may be done in the usual way, for example by mixing or spraying on in a mixer/granulator, optionally followed by heat treatment.

The amorphous alkali metal silicate compounds with multiple wash cycle performance may be used as additives for powder-form to granular detergents or cleaners or as a constituent in the production of granular detergents or cleaners, preferably during the granulation and/or compacting phase. Depending on the method used for their production, the alkali metal silicate compounds may have bulk densities of about 300 to 950 g/l for example. In continuous production, bulk densities of up to 1150 g/l can be reached. By contrast, the detergents or cleaners according to the invention may have a bulk density of 300 to 1200 g/l and preferably in the range from 500 to 1000 g/l and contain the alkali metal silicate compounds according to the invention in quantities of, preferably, 5 to 50% by weight and, more preferably, 10 to 40% by weight. They may be produced by any of the known methods, such as mixing, granulation, compacting, such as roll compacting, and extrusion. Processes in which several components, for example spray-dried components and granulated and/or extruded components, are mixed together are particularly suitable. Spray-dried or granulated components may also be subsequently impregnated in the formulation, for example with nonionic surfactants, more particularly ethoxylated fatty alcohols, by any of the usual methods. In granulation and extrusion processes in particular, the other anionic surfactants optionally present in the form of a spray-dried, granulated or extruded compound may advantageously be used either as a mixing component in the process or as an additive introduced after other granules. It is also possible and, depending on the formulation, can be of advantage subsequently to add other individual components of the detergent, for example carbonates, citrate or citric acid or other polycarboxylates or polycarboxylic acids, polymeric polycarboxylates, zeolite and/or layer silicates, for example layer-form crystalline disilicates, to spray-dried, granulated and/or extruded components optionally impregnated with nonionic surfactants and/or other ingredients liquid to wax-like at the processing temperature. In one preferred process, the surface of components of the detergent or of the detergent as a whole is subsequently treated to reduce the tackiness of the granules and/or to improve their solubility. Suitable surface modifiers are known from the prior art. Besides other suitable surface modifiers, fine-particle zeolites, silicas, amorphous silicates, fatty acids or fatty acid salts, for example calcium stearate, but above all mixtures of zeolite and silica, more particularly in a ratio by weight of zeolite to silica of at least 1:1, or zeolite and calcium stearate are particularly preferred.

Particularly preferred embodiments of the invention are extruded detergents or cleaners with a bulk density above 600 g/l which contain anionic and optionally nonionic surfactants and an amorphous alkali metal silicate compound of the type produced in accordance with the invention in the extrudate. These extruded detergents or cleaners can be produced by known extrusion processes, cf. in particular International patent application WO-A-91/02047. In this extrusion process, a solid free-flowing compound is extruded under pressures of up to 200 bar to form a strand, the strand is cut by means of a cutting unit into granules of predetermined size as it leaves the multiple-bore die and the plastic and optionally still moist crude extrudate is subjected to another shaping step and subsequently dried, the alkali metal silicate compounds according to the invention being used in the compound.

In the production of extruded detergents or cleaners in particular, the alkali metal silicate compounds containing anionic surfactants surprisingly show advantages over alkali metal silicate compound alternatives without anionic surfactants in terms also of process technology. It has been found that extrusion processes in which alkali metal silicate/carbonate compounds with no anionic surfactants are used should not be interrupted because, in the event of an interruption, the extrusion mixture loses its plasticity and surface-slip properties so quickly that restarting of the installation involves safety problems. This problem has been solved by replacing the alkali metal silicate compounds with no anionic surfactants by alkali metal silicates containing anionic surfactants, more particularly by alkali metal silicate compounds containing anionic surfactant and carbonate.

The final detergents or cleaners may additionally contain the following ingredients.

These include, in particular, surfactants, above all anionic surfactants and optionally nonionic surfactants, but also cationic, amphoteric or zwitterionic surfactants.

Suitable anionic surfactants of the sulfonate type are, on the one hand, the alkyl benzenesulfonates, olefin sulfonates and alkane sulfonates mentioned in the foregoing. However, other suitable anionic surfactants of the sulfonate type are the esters of α-sulfofatty acids (ester sulfonates), for example the α-sulfonated methyl esters of hydrogenated coconut oil, palm kernel oil or tallow fatty acids. Other suitable anionic surfactants are the α-sulfofatty acids obtainable by ester cleavage of the α-sulfofatty acid alkyl esters and disalts of these α-sulfofatty acids. In their production on an industrial scale, the monosalts of the α-sulfofatty acid alkyl esters are obtained in the form of an aqueous mixture containing limited quantities of disalts. The disalt content of such surfactants is normally below 50% by weight, for example up to about 30% by weight, based on the anionic surfactant mixture.

Other suitable anionic surfactants are sulfonated fatty acid glycerol esters which are the monoesters, diesters and triesters—and mixtures thereof—obtained where production is carried out by esterification by a monoglycerol containing 1 to 3 moles of fatty acid or in the transesterification of triglycerides containing 0.3 to 2 moles of glycerol.

Other suitable surfactants of the sulfate type are the above-mentioned sulfuric acid monoesters of primary alcohols of natural and synthetic origin and optionally alkoxylated, preferably ethoxylated, derivatives thereof. Other preferred anionic surfactants are the salts of alkyl sulfosuccinic acid, which are also known as sulfosuccinates or as sulfosuccinic acid esters and which represent monoesters and/or diesters of sulfosuccinic acid with alcohols, preferably fatty alcohols and, more particularly, ethoxylated fatty alcohols. Preferred sulfosuccinates contain $C_{8-18}$ fatty alcohol radicals or mixtures thereof. Particularly preferred sulfosuccinates contain a fatty alcohol radical derived from ethoxylated fatty alcohols which, regarded in isolation, represent nonionic surfactants. Among these sulfosuccinates, those of which the fatty alcohol radicals are derived from narrow-range ethoxylated fatty alcohols are particularly preferred. Alk(en)yl succinic acid preferably containing 8 to 18 carbon atoms in the alk(en)yl chain or salts thereof may also be used.

In addition to the anionic surfactants, the detergents may also contain soaps, preferably in quantities of 0.2 to 5% by weight. Suitable soaps are saturated fatty acid soaps, such as the salts of lauric acid, myristic acid, palmitic acid, stearic acid, hydrogenated erucic acid and behenic acid, and soap mixtures derived in particular from natural fatty acids, for example coconut oil, palm kernel oil or tallow fatty acids.

The anionic surfactants and soaps may be present in the form of their sodium, potassium or ammonium salts and in the form of soluble salts of organic bases, such as mono-, di- or triethanolamine. The anionic surfactants are preferably present in the form of their sodium or potassium salts, more particularly in the form of their sodium salts.

In one embodiment of the invention, detergents or cleaners, more particularly extruded detergents or cleaners, containing 10 to 30% by weight of anionic surfactants are preferred. Advantageously, at least 3% by weight and, preferably, at least 5% by weight of these anionic surfactants are sulfate surfactants. In one advantageous embodiment, the detergents or cleaners contain at least 15% by weight and, more particularly, 20 to 100% by weight of sulfate surfactants, based on the anionic surfactants as a whole.

Preferred nonionic surfactants are the alkoxylated, advantageously ethoxylated, alcohols mentioned above preferably containing 8 to 18 carbon atoms and, on average, 1 to 12 moles of ethylene oxide (EO) per mole of alcohol.

In addition, alkyl glycosides corresponding to the general formula $RO(G)_x$, where R is a primary, linear or methyl-branched, more particularly 2-methyl-branched, aliphatic radical containing 8 to 22 and preferably 12 to 18 carbon atoms and G stands for a glycose unit containing 5 or 6 carbon atoms, preferably for glucose, may also be used as further nonionic surfactants. The degree of oligomerization x, which indicates the distribution of monoglycosides and oligoglycosides, is a number of 1 to 10.

Nonionic surfactants of the amine oxide type, for example N-cocoalkyl-N,N-dimethylamine oxide and N-tallow alkyl-N -dihydroxyethylamine oxide, and the fatty acid alkanolamide type are also suitable. The quantity in which these nonionic surfactants are used is preferably no more, in particular no more than half, the quantity in which the ethoxylated fatty alcohols are used.

Other suitable surfactants are polyhydroxyfatty acid amides corresponding to formula (I):

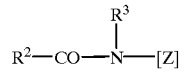

(I)

in which $R^2CO$ is an aliphatic acyl group containing 6 to 22 carbon atoms, $R^3$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups. The polyhydroxyfatty acid amides are known compounds which may normally be obtained by reductive amination of a reducing sugar with ammonia, an alkylamine or an alkanolamine and subsequent acylation with a fatty acid, a fatty acid alkyl ester of a fatty acid chloride.

Nonionic surfactants are preferably present in the detergents or cleaners according to the invention in quantities of 0.5 to 15% by weight and more preferably in quantities of 2 to 10% by weight.

Besides the amorphous alkali metal silicate compounds with multiple wash cycle performance produced in accordance with the invention, the detergents or cleaners according to the invention may also contain other additional builders and co-builders. For example, typical builders, such as phosphates, zeolites and crystalline layer silicates, may be present in the detergents or cleaners. The synthetic zeolite used is preferably finely crystalline and contains bound water. For example, zeolite A is suitable, although zeolite X and zeolite P and mixtures of A, X and/or P may also be used. The zeolite may be used in the form of a spray-dried powder or even in the form of an undried stabilized suspension still moist from its production. Where the zeolite is used in the form of a suspension, it may contain small additions of nonionic surfactants as stabilizers, for example 1 to 3% by weight, based on zeolite, of ethoxylated $C_{12-18}$ fatty alcohols containing 2 to 5 ethylene oxide groups, $C_{12-14}$ fatty alcohols containing 4 to 5 ethylene oxide groups or ethoxylated isotridecanols. Zeolite suspensions and zeolite powders may also be used. Suitable zeolite powders have a mean particle size of less than 10 $\mu$m (volume distribution, as measured by the Coulter Counter Method) and preferably contain 18 to 22% by weight and, more preferably, 20 to 22% by weight of bound water. Zeolite may be present in the detergents or cleaners in quantities of up to about 40% by weight (based on water-free active substances).

In one particularly preferred embodiment of the invention, however, detergents or cleaners contain 10 to 16% by weight of zeolite (based on water-free active substance) and 10 to 30% by weight of an alkali metal silicate compound produced in accordance with the invention.

In another particularly preferred embodiment of the invention, however, the detergents or cleaners contain 0 to 5% by weight of zeolite (based on water-free active substance) and 15 to 40% by weight of an alkali metal silicate compound produced in accordance with the invention. The zeolite may not only be co-extruded, it may also be completely or partly introduced into the detergent or cleaner at a later stage, i.e. after the extrusion step. Detergents or cleaners containing an extrudate free from zeolite inside the extrudate granule are particularly preferred.

Crystalline layer silicates and/or conventional phosphates may also be used as substitutes for the zeolite. However, phosphates are preferably present in only small quantities in the detergents or cleaners, more particularly in quantities of at most 10% by weight.

Particularly suitable crystalline layer silicates are crystalline layer-form sodium silicates corresponding to the general formula $NaMSi_xO_{2x+1}.yH_2O$, where M is sodium or hydrogen, x is a number of 1.9 to 4 and y is a number of 0 to 20, preferred values for x being 2, 3 or 4. Crystalline layer silicates of this type are described, for example, in European patent application EP-A-0 164 514. Preferred crystalline layer silicates corresponding to the above formula are those in which M stands for sodium and x assumes a value of 2 or 3. Both β- and δ-sodium disilicates $Na_2Si_2O_5.yHO_2$ are particularly preferred. However, these crystalline layer silicates are preferably present in the extrudates according to the invention in quantities of not more than 10% by weight, more particularly in quantities of less than 8% by weight and advantageously in quantities of at most 5% by weight.

Polymeric polycarboxylates, for example, may be used as co-builders. Suitable polymeric polycarboxylates are, for example, the sodium salts of polyacrylic acid or polymethacrylic acid, for example those having a relative molecular weight of 800 to 150,000 (based on acid). Particularly suitable copolymeric polycarboxylates are those of acrylic acid with methacrylic acid and those of acrylic acid or methacrylic acid with maleic acid. Copolymers of acrylic acid with maleic acid which contain 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000. Terpolymers are particularly preferred, for example the terpolymers containing salts of acrylic acid and maleic acid and vinyl alcohol or vinyl alcohol derivatives as monomers in accordance with DE-A43 00 772 or salts of acrylic acid and 2-alkyl allyl sulfonic acid and sugar derivatives as monomers in accordance with DE-C42 21 381.

Other useful organic co-builders are the polycarboxylic acids preferably used in the form of their sodium salts, such as citric acid, adipic acid, succinic acid, glutaric acid, tartaric acid, sugar acids, aminocarboxylic acids, nitrilotriacetic acid (NTA), providing their use is not ecologically objectionable, and mixtures thereof. Preferred salts are the salts of polycarboxylic acids, such as citric acid, adipic acid, succinic acid, glutaric acid, tartaric acid, sugar acids and mixtures thereof.

Other suitable builder systems are oxidation products of polyglucosans containing carboxyl groups and/or water-soluble salts thereof, which are described for example in International patent application WO-A-93/08251 or of which the production is described, for example, in International patent application WO-A-93/16110.

Other preferred builders are the known polyaspartic acids and salts and derivatives thereof.

Other suitable builders are polyacetals which may obtained by reaction of dialdehydes with polyol carboxylic acids containing 5 to 7 carbon atoms and at least three hydroxyl groups, for example as described in European patent application EP-A-0 280 223. Preferred polyacetals are obtained from dialdehydes, such as glyoxal, glutaraldehyde, terephthalaldehyde and mixtures thereof, and from polyol carboxylic acids, such as gluconic acid and/or glucoheptonic acid.

These co-builders may be present in the final detergents or cleaners in quantities of, for example, 0.5 to 20% by weight and preferably in quantities of 2 to 15% by weight.

In addition, the detergents may also contain components with a positive effect on the removability of oil and fats from textiles by washing. This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof.

The detergents or cleaners may additionally contain components which further improve the solubility of the heavy granules in particular. Corresponding components and their incorporation are described, for example, in International patent application WO-A-93/02176 and in German patent application DE-A-42 03 031. Preferred components of the type in question include in particular fatty alcohols containing 20 to 80 moles of ethylene oxide per mole of fatty alcohol, for example tallow fatty alcohol containing 30 EO and tallow fatty alcohol containing 40 EO, fatty alcohols containing 14 EO and polyethylene glycols with a relative molecular weight of 200 to 2,000.

Among the compounds yielding $H_2O_2$ in water which serve as bleaching agents, sodium perborate monohydrate is of particular importance. Other useful bleaching agents are, for example, sodium perborate tetrahydrate, sodium percarbonate, peroxypyrophosphates, citrate perhydrates and $H_2O_2$-yielding peracidic salts or peracids, such as perbenzoates, peroxophthalates, diperazelaic acid or diperdodecanedioic acid. The content of bleaching agents in the detergents or cleaners is preferably 5 to 25% by weight and, more particularly, 10 to 20% by weight, perborate monohydrate advantageously being used. Percarbonate is also a preferred constituent. However, percarbonate is preferably not co-extruded but is optionally added in a subsequent step.

In order to obtain an improved bleaching effect where washing is carried out at temperatures of 60° C. or lower, bleach activators may be incorporated in the formulations. Examples of bleach activators are N-acyl or O-acyl compounds which form organic peracids with $H_2O_2$, preferably N,N'-tetraacylated diamines, p-(alkanoyloxy)-benzene sulfonates, carboxylic anhydrides and esters of polyols, such as glucose pentaacetate. Other known bleach activators are acetylated mixtures of sorbitol and mannitol of the type described, for example, in European patent application EP-A-0 525 239. The content of bleach activators in the bleach-containing detergents is in the usual range, preferably from 1 to 10% by weight and more preferably from 3 to 8% by weight. Particularly preferred bleach activators are N,N,N'N'-tetraacetyl ethylenediamine (TAED), 1,5-diacetyl-2,4-dioxohexahydro-1,3,5-triazine (DADHT) and acetylated sorbitol/mannitol mixtures (SORMAN).

It can be of advantage to add typical foam inhibitors to the detergents or cleaners. Suitable foam inhibitors are, for example, soaps of natural or synthetic origin with a high percentage content of $C_{18-24}$ fatty acids. Suitable non-surface-active foam inhibitors are, for example, organopolysiloxanes and mixtures thereof with microfine, optionally silanized silica and also paraffins, waxes, microcrystalline waxes and mixtures thereof with silanized silica or bis-stearyl ethylenediamide. Mixtures of various foam inhibitors, for example mixtures of silicones, paraffins or waxes, are also used with advantage. The foam inhibitors, above all silicone- and/or paraffin-containing foam inhibitors, are advantageously fixed to a granular water-soluble or water-dispersible support. Mixtures of paraffins and bis-stearyl ethylenediamides are particularly preferred.

Suitable enzymes are those from the class of proteases, lipases, amylases, cellulases or mixtures thereof. Enyzmes obtained from bacterial strains or fungi, such as *Bacillus subtilis, Bacillus licheniformis, Streptomyces griseus* and *Humicola insolens,* are particularly suitable. Proteases of the subtilisin type are preferred, proteases obtained from *Bacillus lentus* being particularly preferred. Enzyme mixtures, for example of protease and amylase or protease and lipase or protease and cellulase or of cellulase and lipase or of protease, amylase and lipase or of protease, lipase and cellulase, but especially protease- and/or lipase-containing mixtures are of particular interest. Peroxidases or oxidases have also proved to suitable in some cases. The enzymes may be adsorbed to supports and/or encapsulated in shell-forming substances to protect them against premature decomposition. The percentage content of the enzymes, enzyme mixtures or enzyme granules may be, for example, from about 0.1 to 5% by weight and is preferably from 0.1 to about 2% by weight.

Suitable stabilizers, particularly for per compounds and enzymes, are the salts of polyphosphonic acids, more particularly 1-hydroxyethane-1,1-diphosphonic acid (HEDP), diethylenetriamine pentamethylenephosphonic acid (DETPMP) or ethylenediamine tetramethylenephosphonic acid.

The detergents or cleaners may also contain other enzyme stabilizers. For example, they may contain from 0.5 to 1 % by weight of sodium formate. Proteases which are stabilized with calcium salts and which have a calcium content of preferably about 1.2% by weight, based on the enzyme, may also be used. However, it is of particular advantage to use boron compounds, for example boric acid, boron oxide, borax and other alkali metal borates, such as the salts of orthoboric acid ($H_3BO_3$), metaboric acid ($HBO_2$) and pyroboric acid (tetraboric acid $H_2B_4O_7$).

The function of redeposition inhibitors is to keep the soil detached from the fibers suspended in the wash liquor and thus to prevent discoloration. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (Na salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone may also be used, for example in quantities of 0.1 to 5% by weight, based on the detergent or cleaner.

The detergents or cleaners may contain derivatives of diaminostilbene disulfonic acid or alkali metal salts thereof as optical brighteners. Suitable optical brighteners are, for example, salts of 4,4'-bis-(2-anilino4-morpholino-1,3,5triazinyl6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl) diphenyl, 4,4'-bis-(4-chloro-3-sulfostyryl)-diphenyl or 4(4chlorostyryl)4'-(2-sulfostyryl)-diphenyl, may also be present. Mixtures of the brighteners mentioned above may also be used.

In addition to the alkali metal silicate compounds produced in accordance with the invention, the detergents or cleaners may also contain other amorphous alkali metal silicates of the type described above and alkali metal carbonates and/or alkali metal hydrogen carbonates of the type described above. Other inorganic salts suitable as ingredients are neutral salts, such as sulfates and optionally even chlorides in the form of their sodium and/or potassium salts.

The detergents or cleaners may of course also contain the dyes and fragrances typically present in detergents or cleaners.

EXAMPLES

Example 1

Production of Alkali Metal Silicate/Alkali Metal Carbonate Compounds Containing Anionic Surfactants Alkali metal silicate compounds B1 to B4 according to the invention were obtained in different ways. The composition of the compounds (in % by weight) was as follows:

| | B1 | B2 | B3 | B4 |
|---|---|---|---|---|
| Amorphous sodium disilicate | 28.1 | 28.1 | 28.1 | 28.1 |
| Sodium carbonate | 53.4 | 53.4 | 53.4 | 53.4 |
| $C_{12-18}$ alkyl sulfate (sodium salt) | 3.0 | — | — | — |
| $C_{12}$ alkyl benzenesulfonate (sodium salt) | — | 3.0 | 3.0 | 3.0 |
| Water | 15.5 | 15.5 | 15.5 | 15.5 |

Product B1

53.4 Parts by weight of calcined soda were mixed with 31.4 parts by weight of spray-dried sodium silicate with a molar $Na_2O:SiO_2$ ratio of 1:2.0 (Portil® A, Henkel KGaA) for about 2 minutes in a Lödige FKM 130 D plowshare mixer. An aqueous preparation of 6.6 parts by weight of water-glass solution (molar ratio 1:2, solids content 50% by weight) and 8.6 parts by weight of an aqueous alkyl sulfate paste (solids content 35% by weight) was added to the resulting mixture, followed by mixing for 2 minutes.

Product B2

94.7 parts by weight of a soda/silicate compound obtained by spray drying of a solution of soda and sodium silicate with a molar $Na_2O:SiO_2$ ratio of 1:2 in accordance with German patent application 195 01 269.0 were introduced into the mixing unit described above. 5.3 parts by weight of an aqueous paste of alkyl benzenesulfonate (solids content 56.6% by weight) were then added with mixing for 1 minute, followed by mixing for another 3 minutes. The mixture was dried to a free water content of 2.4% by weight by heating for 15 minutes to 70° C. The free water content was determined using a Satorius MA 30 Moisture Analyzer. To this end, the sample to be analyzed is uniformly distributed over an aluminium weighing pan and dried by infrared heating from above. The drying temperature is controlled by a temperature sensor in the vicinity of the heating coil and is of the order of 130° C. The exact drying temperature and the necessary drying time have to be determined by calibration. In this method of determination, only the water capable of being evaporated up to a temperature of about 130° C. is determined, but not the water chemically bound to the amorphous silicate which requires higher temperatures for removal.

Product B3

In accordance with the production of product B1, 53.4 parts by weight of calcined soda and 35.13 parts by weight of sodium silicate were introduced into the mixing unit and mixed for 2 minutes. 5.45 Parts by weight of an aqueous paste of alkyl benzenesulfonate (solids content 55% by weight) and 6.02 parts by weight of water were added to the resulting mixture, followed by mixing for another 2 minutes.

Product B4

In accordance with the production of product B1, 53.4 parts by weight of calcined soda and 27.5 parts by weight of sodium silicate were introduced into the mixing unit and mixed for 2 minutes. 5.5 Parts by weight of an aqueous paste of alkyl benzenesulfonate (solids content 55% by weight) and 13.6 parts by weight of the waterglass solution used for product B1 were then added, followed by mixing for 2 minutes.

The particle size distribution of the products obtained was determined by sieve analysis. The following distributions were obtained:

| Fraction | % by weight particles in product | | | |
|---|---|---|---|---|
| (mm) | B1 | B2 | B3 | B4 |
| >1.6 | 0 | 0 | 0 | 0 |
| >1.0–1.6 | 0.6 | 0.8 | 1.4 | 2.0 |
| >0.8–1.0 | 1.5 | 2.2 | 2.7 | 4.1 |
| >0.6–0.8 | 4.6 | 9.3 | 4.9 | 7.3 |
| >0.4–0.6 | 5.0 | 22.7 | 6.3 | 6.2 |
| >0.2–0.4 | 9.4 | 41.9 | 15.7 | 16.3 |
| >0.1–0.2 | 36.8 | 22.6 | 43.9 | 38.9 |
| >0.05–0.1 | 35.5 | 1.5 | 24.0 | 21.9 |
| >0.05 | 7.3 | 0.1 | 1.0 | 2.7 |

The products had the following bulk densities (g/l): B1 809, B2 465, B3 704 and B4 719.

Example 2

Absorption Capacity of the Alkali Metal Silicate Compounds for Nonionic Surfactant The absorption capacity of alkali metal silicate compounds B1 to B4 according to the invention for the nonionic surfactant $C_{12-18}$ fatty alcohol.7 EO was tested by comparison with the same quantity of Nabion® 15, a surfactant-free soda/silicate compound obtainable from Rhône-Poulenc, which was assumed to have been produced in accordance with EP-A-488 868. The nonionic surfactant absorption capacity was determined in accordance with DIN ISO 787, the linseed oil specified therein being replaced by the above-mentioned nonionic surfactant. For this determination, a weighed quantity of sample is placed on a plate. Nonionic surfactant is slowly added from a burette 4 or 5 drops at a time. After each addition, the nonionic surfactant is rubbed into the powder with a spatula. Addition of the nonionic surfactant is continued until agglomerations of nonionic surfactant and powder have formed. From this point on, one drop of nonionic surfactant at a time is added and rubbed in with the spatula. Addition of the nonionic surfactant is terminated when a soft paste is obtained. This paste should still just spread without breaking or crumbling and should still just adhere to the plate. The quantity of nonionic surfactant is read off from the burette and converted into ml of nonionic surfactant per 100 g of sample. The following results were obtained:

| | ml Nonionic surfactant per 100 g of support |
|---|---|
| B1 | 75 |
| B2 | 80 |
| B3 | 97 |
| B4 | 70 |
| Nabion ® 15 | <30 |

Example 3

Extrudability

Extrudates E5 to E8 according to the invention were produced in accordance with the teaching of International patent application WO-A-91/02047. The extrusion mixtures of extrudates E5 to E8 could be extruded without any problems. The compositions of the extrudates were as shown in Table 1. Their bulk densities were between 800 and 830 g/l. The extrudates according to the invention showed good dissolving behavior: only small residues were obtained in the dispensing and solubility tests.

Compositions of E5 to E8 (in % by weight)

| | E5 | E6 | E7 | E8 |
|---|---|---|---|---|
| $C_{9-13}$ Alkyl benzenesulfonate | 11.5 | 11.5 | 11.5 | 11.5 |
| $C_{12-18}$ Alkyl sulfate | 10.5 | 10.5 | 10.5 | 10.5 |
| $C_{12-18}$ Alcohol · 7 EO | 4.0 | 4.0 | 4.0 | 4.0 |
| $C_{12-18}$ Fatty acid soap | 1.0 | 1.0 | 1.0 | 1.0 |
| Polyethylene glycol, relative molecular weight 400 | 1.5 | 1.5 | 1.5 | 1.5 |
| Zeolite (water-free active substance) | 19.0 | 19.0 | 19.0 | 19.0 |
| Acrylic acid/maleic acid copolymer (sodium salt) | 6.0 | 6.0 | 6.0 | 6.0 |
| Alkali metal silicate compound B1 | 14.0 | — | — | — |
| Alkali metal silicate compound B2 | — | 14.0 | — | — |
| Alkali metal silicate compound B3 | — | — | 14.0 | — |
| Alkali metal silicate compound B4 | — | — | — | 14.0 |
| Perborate monohydrate | 21.0 | 21.0 | 21.0 | 21.0 |
| Phosphonate | 0.7 | 0.7 | 0.7 | 0.7 |
| Sodium sulfate | 1.5 | 1.5 | 1.5 | 1.5 |
| Water and salts from solutions | Balance | Balance | Balance | Balance |

What is claimed is:

1. An extruded detergent composition having a bulk density above 600 g./l. containing 15% to 50% by weight of alkali metal silicate wherein said alkali metal silicate is x-ray amorphous and has a molar $M_2O$ to $SiO_2$ ratio of 1:1.5 to 1:3.3 and M represents an alkali metal, 30% to 70% by weight of alkali metal carbonate, 1.5% to 15% by weight of anionic surfactant and 12% to 19% by weight of water, based on the weight of said composition.

2. The process of producing a detergent composition comprising extruding under a pressure of up to 200 bar to form a strand of said composition, said composition containing 15% to 50% by weight of alkali metal silicate wherein said alkali metal silicate is x-ray amorphous and has a molar $M_2O$ to $SiO_2$ ratio of 1:1.5 to 1:3.3 and M represents an alkali metal, 30% to 70% by weight of alkali metal carbonate, 1.5% to 15% by weight of anionic surfactant and 12% to 19% by weight of water, based on the weight of said composition, cutting said strand into granules, and optionally shaping and drying the granules.

* * * * *

UNITED STATES PATENT AND TRADEMARK OFFICE

CERTIFICATE OF CORRECTION

PATENT NO. : 6,034,050
DATED : March 7, 2000
INVENTOR(S) : Artiga Gonzalez et al.

It is certified that error appears in the above-identified patent and that said Letters Patent is hereby corrected as shown below:

Title page, Item [54] and Column 1, lines 1-2,
Delete the title, "AMORPHOUS ALKALI METAL SILICATE COMPOUND", and insert therefor -- ANIONIC SURFACTANT CONTAINING ALKALI METAL SILICATE-ALKALI METAL CARBONATE COMPOUND IN AGGLOMERATED FORM --.

Signed and Sealed this

Twenty-first Day of October, 2003

JAMES E. ROGAN
*Director of the United States Patent and Trademark Office*